US008397328B2

(12) United States Patent
Hendrickson et al.

(10) Patent No.: US 8,397,328 B2
(45) Date of Patent: Mar. 19, 2013

(54) APPARATUS AND METHOD FOR CONTROLLING CONCENTRATION OF WASH AID IN WASH LIQUID

(75) Inventors: Michael Stephen Hendrickson, Saint Joseph, MI (US); Colleen M. Doyle, Stevensville, MI (US); Frank Nekic, Saint Joseph, MI (US); Joel Adam Luckman, Benton Harbor, MI (US); Ayomide Fawole, Chicago, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 896 days.

(21) Appl. No.: 12/166,193

(22) Filed: Jul. 1, 2008

(65) Prior Publication Data

US 2010/0000573 A1 Jan. 7, 2010

(51) Int. Cl.
*D06F 35/00* (2006.01)
*D06F 39/02* (2006.01)
*D06F 33/00* (2006.01)

(52) U.S. Cl. ..... 8/158; 68/12.18; 68/17 R

(58) Field of Classification Search ..... 68/12.18, 68/17 R; 8/158, 159
See application file for complete search history.

(56) References Cited

U.S. PATENT DOCUMENTS

| | | | | |
|---|---|---|---|---|
| 2,576,253 | A * | 11/1951 | Farrell et al. | 137/93 |
| 3,645,669 | A | 2/1972 | Rausch | |
| 4,328,600 | A * | 5/1982 | Bochan | 8/159 |
| 4,862,711 | A | 9/1989 | Ikeda et al. | |
| 5,167,722 | A * | 12/1992 | Pastryk et al. | 134/33 |
| 5,253,379 | A | 10/1993 | Dusamos et al. | |
| 5,315,847 | A | 5/1994 | Takeda et al. | |
| 5,370,743 | A | 12/1994 | Usui et al. | |
| 5,389,344 | A | 2/1995 | Copeland et al. | |
| 5,396,316 | A | 3/1995 | Smith | |
| 5,530,531 | A | 6/1996 | Girard | |
| 5,970,273 | A | 10/1999 | Zenk et al. | |
| 6,290,346 | B1 | 9/2001 | Santhanam et al. | |
| 6,364,472 | B1 | 4/2002 | Hmelar et al. | |
| 6,463,611 | B1 | 10/2002 | Mattia et al. | |
| 6,958,693 | B2 | 10/2005 | Rothgeb et al. | |
| 7,124,039 | B2 | 10/2006 | Gadini et al. | |
| 7,275,552 | B2 | 10/2007 | DeWeerd et al. | |
| 2003/0227394 | A1 * | 12/2003 | Rothgeb et al. | 340/870.01 |
| 2004/0221625 | A1 | 11/2004 | Aouad | |
| 2005/0086979 | A1 * | 4/2005 | Son et al. | 68/3 R |
| 2006/0260065 | A1 * | 11/2006 | Wright et al. | 8/158 |

(Continued)

FOREIGN PATENT DOCUMENTS

| | | | |
|---|---|---|---|
| DE | 3901686 | A1 | 7/1990 |
| DE | 10042713 | A1 | 3/2002 |

(Continued)

OTHER PUBLICATIONS

Explanation of Refractive Index, German Wikipedia, Brechungsindex: In: Wikipedia, Die freie Enzyklopadie. Bearbeitungsstand: Jun. 29, 2008, 13:41. URL: http://de.wikipedia.org/w/index.php[abgerufen am Nov. 10, 2011].

*Primary Examiner* — Saeed T Chaudhry
(74) *Attorney, Agent, or Firm* — Clifton G. Green; McGarry Bair PC

(57) ABSTRACT

An apparatus and method of using an automatic washing machine to determine a concentration of a wash aid in a wash liquid, and implementing a controlled flushing of the wash aid in response to the determined concentration.

44 Claims, 5 Drawing Sheets

U.S. PATENT DOCUMENTS

| | | | | |
|---|---|---|---|---|
| 2006/0272359 | A1* | 12/2006 | Kang | 68/17 R |
| 2007/0102024 | A1 | 5/2007 | Classen | |
| 2007/0143933 | A1* | 6/2007 | Potyrailo et al. | 8/158 |
| 2007/0143934 | A1 | 6/2007 | Potyrailo et al. | |

FOREIGN PATENT DOCUMENTS

| | | | |
|---|---|---|---|
| EP | 0205671 | A1 | 12/1986 |
| EP | 0478888 | A1 | 4/1992 |
| EP | 0649933 | A1 | 4/1995 |
| EP | 0864684 | A1 | 9/1998 |
| EP | 1731654 | | 12/2007 |
| GB | 2130606 | A | 6/1984 |
| GB | 2134078 | A | 8/1984 |
| JP | 3106393 | A | 5/1991 |
| WO | 0220893 | A1 | 3/2002 |
| WO | 2006102373 | A1 | 9/2006 |

* cited by examiner

APPARATUS AND METHOD FOR CONTROLLING CONCENTRATION OF WASH AID IN WASH LIQUID

BACKGROUND OF THE INVENTION

Conventional automatic cleaning appliances, such as washing machines, dishwashers, and the like, involve the mixing of a wash aid with water to create a wash liquid to facilitate the cleaning process. These wash aids may include detergents, water softeners, fabric softeners, whitening agents, brightening agents, in-wash stain removers, color safe bleaches, peroxygen bleaches and the like. One dispensing method is for the appropriate quantity of wash aid to be added to the cleaning appliance by an operator prior to the initiation of the laundering cycle. The operator places the wash aid in a dispenser, and the wash aid is introduced into the water at a preselected step in the cleaning cycle. The effectiveness of the wash aid is dependent, at least in part, on the quantity of wash aid dispensed. Thus, accurate measuring and dispensing of the wash aid is very desirable.

Conventional cleaning appliances, such as washing machines and dishwashers, require a specific amount of detergent in order to optimize cleaning and minimize the generation of excess suds, which can be detrimental to the cleaning process and certain components, particularly pumps. High concentrations of detergent can also be damaging to certain fabrics. The quantity of detergent required will be dependent on the concentration of the detergent. Thus, for example, if too large a quantity of a high-concentration detergent is dispensed, excessive sudsing can occur, or fabrics can be damaged. Conversely, if too low a quantity of a low-concentration detergent is used, soil removal from the laundered items can be less effective.

The most common cause of incorrect concentrations is user error. Users have been known to fill the dispenser with too much or too little wash aid. As current dispensing systems flush all of the wash aid in the dispenser into the cleaning appliance, the amount of wash aid filled by the user will control the concentration of the wash liquid. Thus, the concentration of cleaning aid in the wash liquid or rinse liquid may vary considerably.

SUMMARY OF THE INVENTION

A method and apparatus for using an automatic washing machine to determine a concentration of a wash aid in a wash liquid, and implementing a controlled dispensing of the wash aid in response to the determined concentration.

DESCRIPTION OF AN EMBODIMENT OF THE INVENTION

Figure 1:
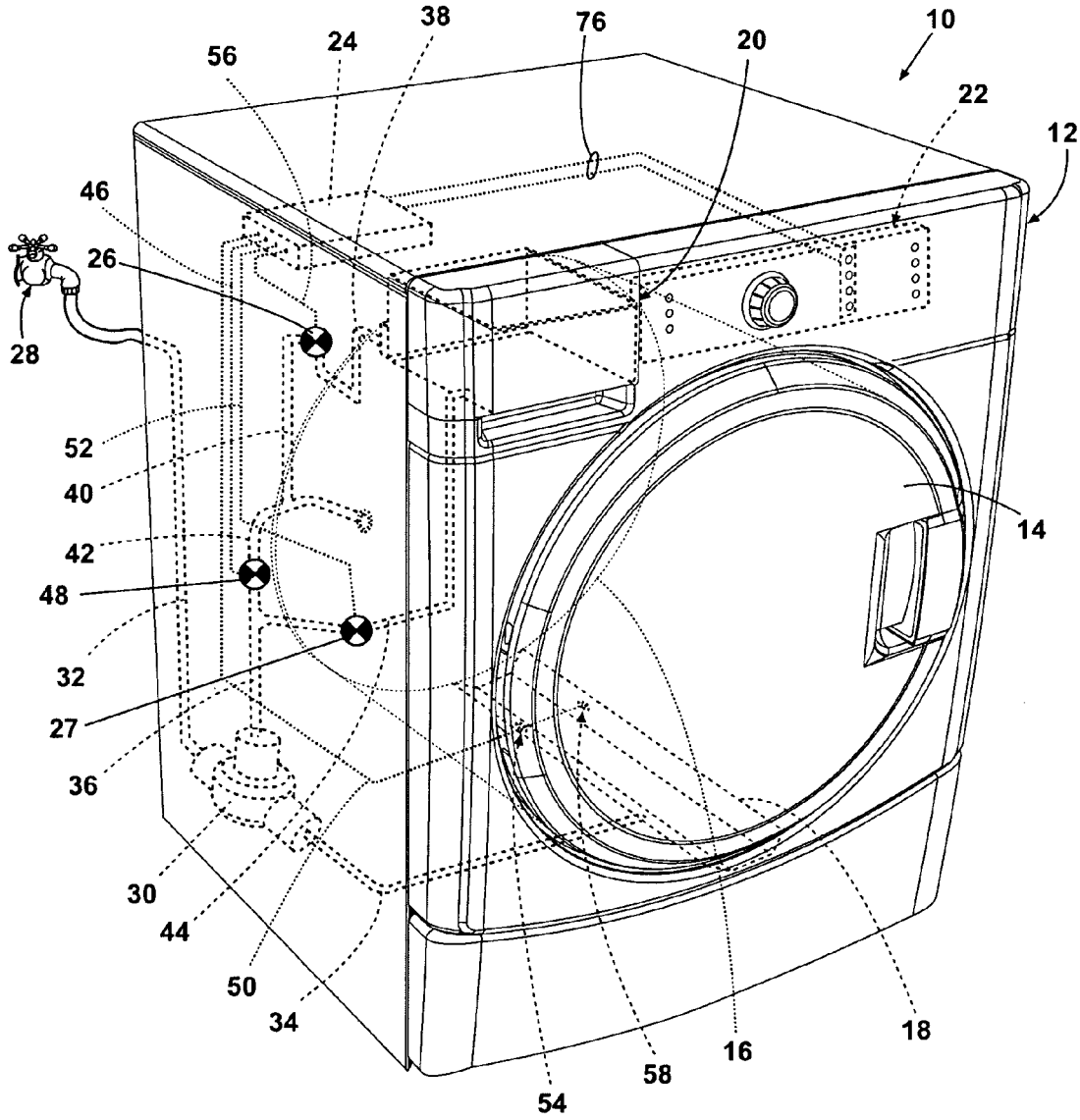
FIG. 1 is a perspective, partly schematic, view of a first embodiment of the invention as an automatic clothes washing machine having at least one concentration sensor, in the form of a refractive index sensor assembly, for determining the concentration of a wash aid.

The invention disclosed herein is suitable for use in a variety of automatic washing machines, such as clothes washing machines and dishwashing machines. Clothes washing machines may be typically categorized as either a vertical axis washing machine or a horizontal axis washing machine. While there are situations where technology may not be transferable between horizontal axis machines and vertical axis machines, the invention disclosed herein may be suitable for use in both horizontal axis and vertical axis automatic clothes washing machines.

As used herein, the "vertical axis" washing machine refers to a washing machine having a rotatable drum that rotates about a generally vertical axis relative to a surface that supports the washing machine. However, the rotational axis need not be vertical. The drum may rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum may rotate about an axis inclined relative to the horizontal axis, with fifteen degrees of inclination being one example of inclination.

One way in which vertical axis and horizontal axis machines may be differentiated is by the manner in which they impart mechanical energy to the fabric articles. In vertical axis machines, a fabric moving element typically moves within a drum to impart mechanical energy directly to the clothes or indirectly through wash liquid in the drum. In horizontal axis machines, mechanical energy is typically imparted to the clothes by the tumbling action formed by the repeated lifting and dropping of the clothes, which may be typically implemented by the rotating drum. While the invention disclosed herein may be suitable for use in both horizontal axis and vertical axis automatic clothes washing machines, the invention will be illustrated and described in the context of a horizontal axis washing machine.

Known horizontal axis washing machines are typically divided into one of two types based upon their washing action and water usage. The first type is known as a "tumble wash;" the second type is known as a "recirculating wash."

In the tumble wash, wash liquid is added to the tub so that the bottom of the drum and items resting in the bottom of the drum, are submerged or partially submerged. As the drum rotates, items are lifted up and dropped into the wash liquid in the bottom of the drum. This action imparts mechanical energy to the items to facilitate their cleaning.

In the recirculating wash, the drum and items to be laundered are typically rotated while wash liquid is recirculated from the sump and sprayed on the items. The force of the liquid sprayed through the items facilitates their cleaning. An advantage of the recirculating wash is that less water may be used, even to the point where in some instances no water extends into the drum.

In the description that follows, a specific functionality relating exclusively to either the tumble wash or the recirculating wash will be indicated. Otherwise, the functionality will be considered equally applicable to both washes.

Referring now to the drawings, and in particular to FIG. 1, a first embodiment of the invention is illustrated as a horizontal axis automatic clothes washing machine 10. The clothes washing machine 10 may include a cabinet 12 enclosing components typically found in a conventional washing machine, such as motors, pumps, fluid lines, controls, sensors, transducers, and the like. Such components will not be described further herein except as necessary for a complete understanding of the invention.

A door 14 may be provided for access to the interior tub 16 and drum 17 (FIG. 2) suspended in the interior of the cabinet 12. The interior of the drum 17 defines a cleaning chamber in which the laundry items are placed for cleaning. The tub 16 may be associated with a sump 18 for carrying a liquid used during a laundering cycle.

A wash aid source may be fluidly coupled with the cleaning chamber and the sump. An embodiment of a wash aid source may include a dispenser drawer 20 for dispensing wash aids during a laundering cycle, such as laundry detergent, water softener, fabric softener, anti-sudsing agent, fabric whitening agent, fabric brightening agent, bleach, in-wash stain removers, color-safe bleaches, peroxygen bleaches or other oxidizing agents, a disinfectant, and the like. The dispenser drawer 20 may be configured for one or both of a single use dispenser having one or more cups or compartments, each of which may hold a different wash aid that may be flushed out at selected intervals during the laundry cycle, or a multiple use dispenser. A single use dispenser must be replenished with a preselected volume of one or more selected wash aids before each laundry cycle. A multiple use dispenser, also referred to as a bulk wash aid dispenser, holds enough wash aid for multiple cycles. While the dispenser drawer may be configured for one or both of a single use dispenser and a bulk wash aid dispenser, the embodiment of the invention as described focuses on a bulk wash aid dispenser. Other wash aid sources may include a pump assembly, a pressurized wash aid reservoir, a gravity-feed reservoir, and the like.

A suitable dispenser for dispensing as both a single wash aid dispenser and a bulk wash aid dispenser may be found in concurrently-filed, commonly-owned U.S. patent application Ser. No. 12/165,712, filed Jul. 1, 2008, entitled "A Household Cleaning Appliance With A Dispensing System Operable Between A Single Use Dispensing System And A Bulk Dispensing System," bearing Applicant's docket number US20080054, which is incorporated herein by reference in its entirety.

A user interface 22 is provided and includes operational controls such as dials, lights, switches, and displays enabling a user to input commands to a controller 24 and receive information about a specific laundry cycle. The user interface 22 may be electrically coupled with the controller 24 through user interface leads 76. A water supply system comprising a pump 30 fluidly coupled with a water supply 28, and a pair of valves 27, 48 is provided for controlling the dispensing of water to the dispensing drawer 20 and the tub 16.

Figure 2:
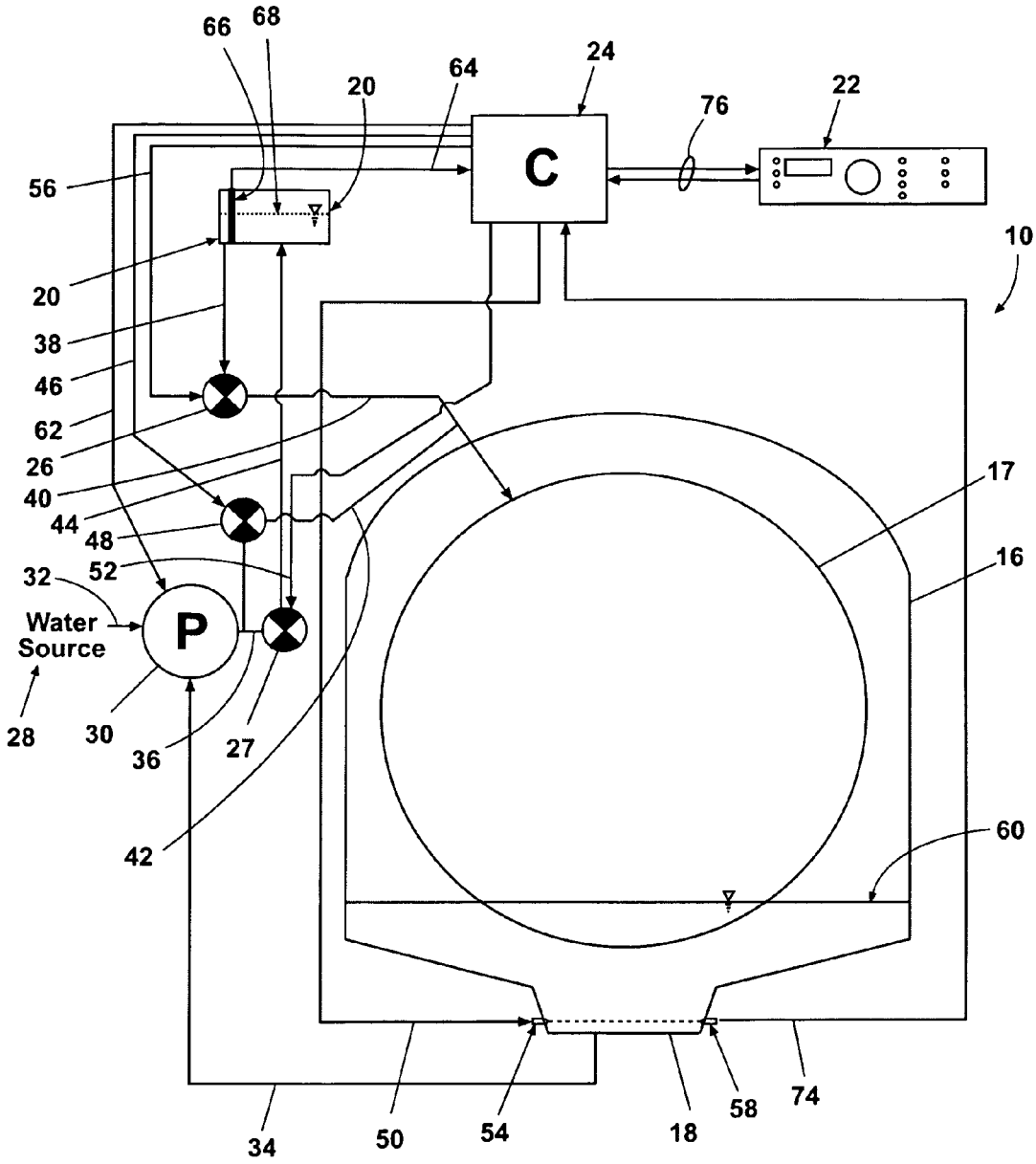
FIG. 2 is a schematic view of the automatic clothes washing machine illustrated in FIG. 1 according to one embodiment of the invention.

Referring to FIG. 2, the water supply system is illustrated as having a single pump 30. The pump 30 is illustrated as fluidly coupled with the sump 18 through a sump line 34. The pump 30 is also illustrated as fluidly coupled with a flush valve 27 through a pump output line 36. The flush valve 27 may be fluidly coupled through a flush line 44 with the dispenser drawer 20 for selectively flushing wash aids from the dispenser drawer 20 to the tub 16 and sump 18, thereby producing a wash liquid having a selected concentration of wash aid. The pump 30 is also illustrated as fluidly coupled with a circulation valve 48 through the pump output line 36. The circulation valve 48 may be fluidly coupled through a recirculating line 42 with the tub 16 for recirculating wash liquid from the sump 18 to the tub 16. The dispenser drawer 20 may also be fluidly coupled through a dispenser output line 38 with a dispenser valve 26, which may in turn be fluidly coupled with the tub 16 through a dispensing line 40.

Other configurations of a fluid delivery system may be utilized, including systems having a plurality of pumps. For example, if the pressure of the water supply is great enough, the pump 30 may not be necessary and may easily be replaced by a valve or other type of water diverter. If recirculation is desired, however a pump 30 would still be needed. However, a more simple pump may be used just for the recirculation, with the valve or diverter controlling the supply of water to the tub 16 or dispensing drawer 20.

With the configuration of FIG. 2, fresh water may be delivered from the pump 30 through the flush valve 27 into the dispensing drawer 20 for selectively flushing cleaning aids from the dispensing drawer 20 through the dispenser output line 38, the dispenser valve 26, and the dispensing line 40 into the tub 16. The dispenser valve 26 may be electrically coupled with the controller 24 through a dispenser valve control lead 56 to enable controlling of the dispenser valve 26. The flush valve 27 may be electrically coupled with the controller 24 through a flush valve control lead 52 to enable controlling of the flush valve 27. Similarly, the circulation valve 48 may be electrically coupled with the controller 24 through a circulation valve control lead 46 to enable controlling of the circulation valve 48. The controller 24 may control the operation of the valves 26, 27, 48 in response to instructions received from the user interface 20 as a result of selections made by the user, such as laundry cycle, water temperature, spin speed, extra rinse, and the like.

A concentration sensor may provided in the sump for determining the concentration of the wash aid. While any suitable concentration sensor may be used, as illustrated, the concentration sensor is a refractive index sensor including a light beam transmitter 54 and a sump receiver 58. The sump receiver 58 may be electrically coupled with the controller 24 through a sump receiver output lead 74, and the light beam transmitter 54 may be electrically coupled with the controller 24 through a transmitter input lead 50 for control of a light beam projected from the light beam transmitter 54 through the wash aid to the sump receiver 58. A beam of light may be projected through the wash aid from the transmitter 54 onto the receiver 58, which generates a signal indicative of the concentration of the wash aid, which may be delivered to the controller 24 through the dispenser receiver output lead 74. A suitable sensor includes a refractive index sensor, such as a Model DGWS1 liquid refractive index sensor, available from Thorlabs of Newton, N.J.

Other types of sensors may be used to determine the concentration of a wash aid in the wash liquid. Examples of such sensors include a resistivity sensor having a pair of electrodes in contact with the wash liquid, a pH sensor, an oxidation/reduction sensor, a chemical sensor, and the like, capable of generating a signal proportional to the concentration of the wash aid in the wash liquid.

The description that follows will disclose a method of preparing a wash liquid in the clothes washing machine 10 having a selected concentration of wash aid, such as a detergent, therein. The method involves controlled flushing of the detergent from the dispenser drawer 20 to the sump 18, and controlled addition of water directly to the sump 18, in order to produce a wash liquid having a selected wash aid concentration, without having to dispense all of the wash aid in the dispenser drawer 20 as with prior art dispensing systems.

The method balances two parameters for the wash liquid: wash aid concentration and target wash liquid volume. The method controls the flushing of the wash aid from the dispenser drawer 20 to reach the desired concentration for the wash liquid. If necessary, the method stops flushing of the dispenser drawer 20 to prevent too high a concentration, even if a quantity of wash aid remains in the dispensing drawer. In those cases where sufficient wash aid has been dispensed to obtain the desired concentration for the target wash liquid volume, but the total wash liquid is still below the target wash liquid volume, the controller will introduce water into the tub to reach the total wash liquid volume, without causing the dispensing of the remaining wash aid.

In those situations where the wash aid is not sufficient to obtain the desired concentration for the target wash liquid volume, the controller will apply control logic to determine the appropriate action. The control logic may determine whether to proceed with the cycle or stop the cycle. For example, the control logic may proceed with the cycle when the combination of concentration and wash liquid volume will not damage the laundry, but might reduce the cleaning performance; and the control logic may stop the cycle and display an error signal when the combination of concentration and wash liquid volume will damage the laundry or the appliance.

Figure 3:
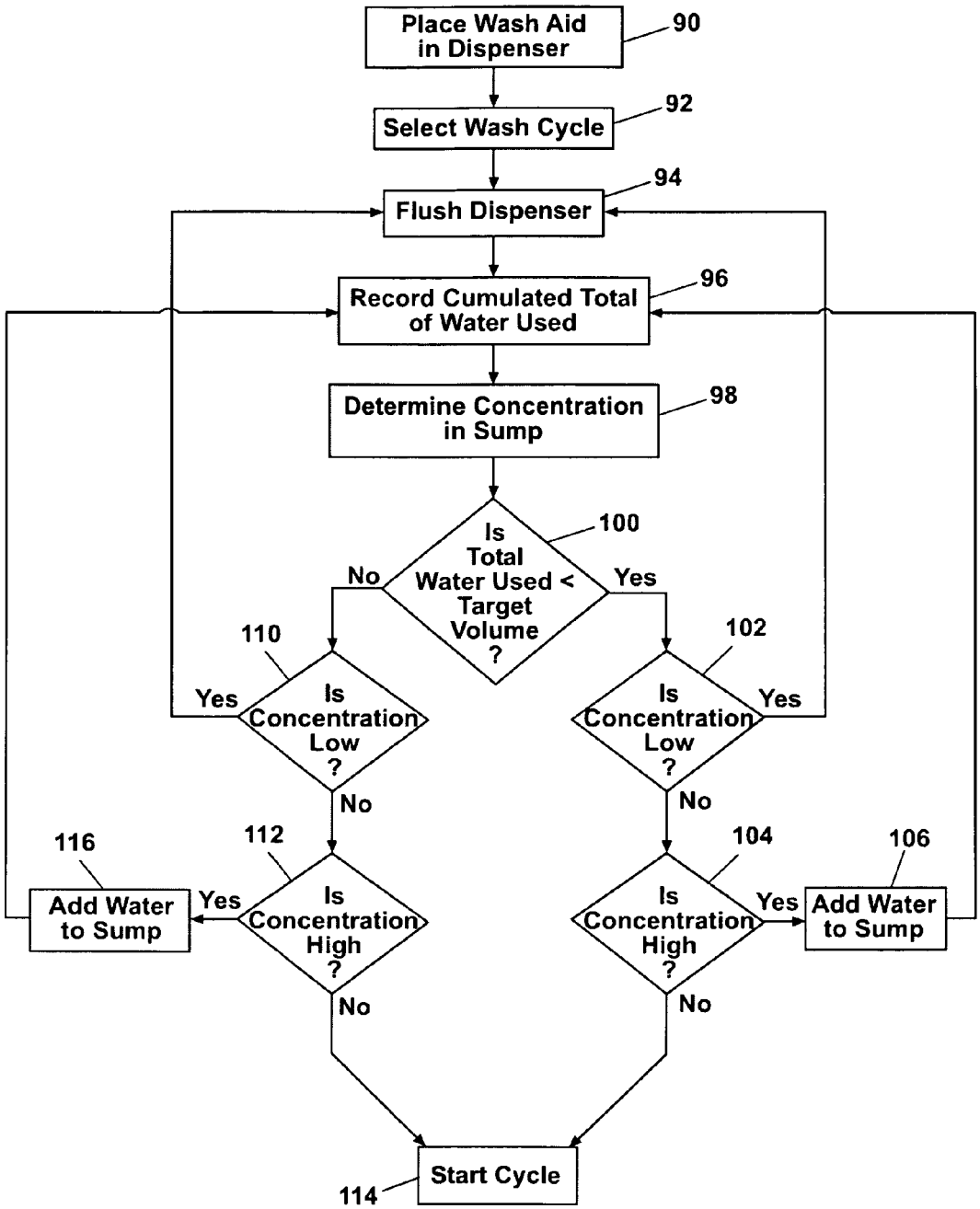
FIG. 3 is a flowchart according to one embodiment of the invention illustrating a method of controlling the operation of the automatic clothes washing machine illustrated in FIG. 1 by determining the concentration of a wash aid in a wash liquid through a refractive index sensor.

One example of the method according to one embodiment of the invention is illustrated in FIG. 3, which begins with loading wash aid into the dispenser at 90, where a user introduces a quantity of a wash aid, such as laundry detergent, into the dispenser drawer 20. The user then selects a laundry cycle at 92, which is usually the appropriate laundry cycle for the items being laundered. The loading of the wash aid at 90 may precede or follow the selecting of the laundry cycle at 92.

The user interface 22 may include various input devices for selecting the wash cycle and options for the wash cycle, such as load size, degree of soiling, wash and rinse temperatures, etc. Alternatively, the clothes washing machine 10 may include a way to determine one or more of the options, such as a motor torque sensor for determining the wet or dry load weight.

The selected laundry cycle and the size of the load may be used to determine the volume of wash liquid to be used, i.e. a target volume. The controller 24 may store a matrix of laundry cycles, load sizes, wash liquid concentrations, and wash liquid volumes. For a particular laundry cycle and load size, a target volume and concentration may be indicated from the matrix. This volume and concentration may be utilized by the controller 24 to control the selected laundry cycle.

Once the wash cycle is selected at 92, a selected volume of water, which may or may not be the volume of water needed to wash the laundry, may be introduced into the dispenser drawer 20 at 94 to flush a portion of the wash aid and the selected volume of water directly into the sump 18, or into the tub 16 and then into the sump 18. The selected volume of water may be recorded in the controller 24 in a cumulative water count at 96 to maintain a cumulative total of water utilized in the flushing operation. This cumulative total may be compared in the controller 24 to the target volume of water required to prepare the wash liquid appropriately for the selected laundry cycle and load size.

The concentration of detergent in the wash liquid residing in the sump 18 may be determined at 98 utilizing the refractive index sensor. The cumulative total of the water added may be compared in the controller 24 to the target volume in a water volume comparison at 100. The measured concentration may be compared in the controller 24 to the concentration of detergent in the wash liquid desired for the selected laundry cycle and load size, i.e. the target concentration, at 102. The measured concentration may be less than the target concentration, or greater than the target concentration. If the concentration must be adjusted, the manner in which the concentration may be adjusted may depend upon the cumulative volume of water utilized, and whether the concentration is less than or greater than the target concentration.

A low concentration results at 102 if the cumulative volume of the water used has flushed less than the target volume of wash aid for the selected laundry cycle and load size. In such a case, an additional selected volume of water may be introduced into the dispenser drawer 20 to flush additional detergent into the sump 18 in another flushing of the dispenser at 94. The additional selected volume of water may be added to the cumulative total of water utilized in the flushing operation in the cumulative water determination at 96. The concentration determination of the wash liquid in the sump 18 may again be determined at 98. A new cumulative total of water may be compared in the controller 24 to the target volume in another water volume comparison at 100. If the cumulative total of water remains less than the target volume, another low concentration determination 102 may be implemented, and the cycle repeated as desired until the volume and concentration are at the target values, and the wash cycle may be started 114.

If the cumulative total of the water used is less than the volume of water required for the selected laundry cycle and load size as determined at 100, but the wash liquid concentration in the sump 18 is not less than the target concentration as determined in the low concentration step 102, a high concentration determination is conducted at 104 to determine whether the wash liquid concentration in the sump 18 is greater than the target concentration. If it is not, i.e. it is at the target concentration, control may then pass to 114, and the wash cycle may be started.

If the wash liquid concentration in the sump 18 is greater than the target concentration, an additional volume of water may be added to the sump 18 at 106. The additional volume of water may be added to the cumulative total in the cumulative water determination at 96, followed by determination of the concentration of the wash liquid in the sump at 98. The new cumulative total of water may be compared in the controller 24 to the target volume in another water volume comparison at 100, and the wash liquid concentration compared to the target concentration in another low concentration determination at 102. The process may be repeated until the cumulative total of the water used equals the target volume, and the concentration of the wash liquid is at the target concentration. Control may then pass to 114, and the wash cycle may be started.

If the cumulative total of the water used is not less than the target volume (step 100), the wash liquid concentration may be compared in the controller 24 to the target concentration of detergent in the wash liquid at 110. If the wash liquid concentration in the sump 18 is less than the target concentration, additional flushing of the detergent from the dispenser drawer 20 may be completed in another dispenser flush at 94 in order to increase the concentration in the sump 18 to the target concentration. This may be accomplished by flushing the detergent from the dispenser drawer 20 using a minimal quantity of water, or by metering the detergent from the dispenser drawer 20 directly without adding water. If the wash liquid concentration in the sump 18 is not less than the target concentration, a determination may be made whether the wash liquid concentration in the sump 18 is greater than the target concentration in a high concentration determination at 112. If it is not, i.e., it is at the target concentration, the laundry cycle may be started in a start cycle step 114.

If the wash liquid concentration in the sump 18 is greater than the target concentration, additional water may be added to the sump 18 at 116. The additional volume of water may be added to the cumulative total in the cumulative water determination at 96, followed by a determination of the wash liquid concentration in the sump 18 at 98. The new cumulative total of water may be compared in the controller 24 to the target volume in another water volume comparison at 100, and the wash liquid concentration compared to the target concentration in another high concentration determination at 112. The process may be repeated until the cumulative total of the water used equals the target volume, and the concentration of the wash liquid is at the target concentration. Control may then pass to 114, and the wash cycle may be started. It may be necessary at the end of this process to empty the sump 18 of some of the wash liquid in order to reduce the volume of wash liquid to the target volume for the selected laundry cycle and load size.

There may be instances in which the volume of water and the concentration of wash aid in the wash liquid cannot be adjusted to meet the target volume and target concentration. In such a case, the controller 24 may be configured to halt the wash cycle, generate an audio signal, generate a visual signal, generate an error code, add a rinse cycle, or a combination thereof. Alternatively, if the concentration exceeds the target concentration, a suds reducer may be dispensed.

If the automatic clothes washing machine 10 is a "recirculating wash" machine, or if the washing machine 10 is selectively capable of both a "tumble wash" and a "recirculating wash," and a "recirculating wash" has been selected, an excessive quantity of wash aid resulting from, for example, selection of a lower concentration wash aid than actually provided may be remedied by the addition of water to the wash liquid, as previously described. Depending upon the resulting volume of wash liquid, the recirculating wash may be utilized as selected, or the laundry cycle may continue as a "tumble wash" in order to avoid the generation of excessive suds or damage to laundered items from the high concentration wash aid.

Figure 4:
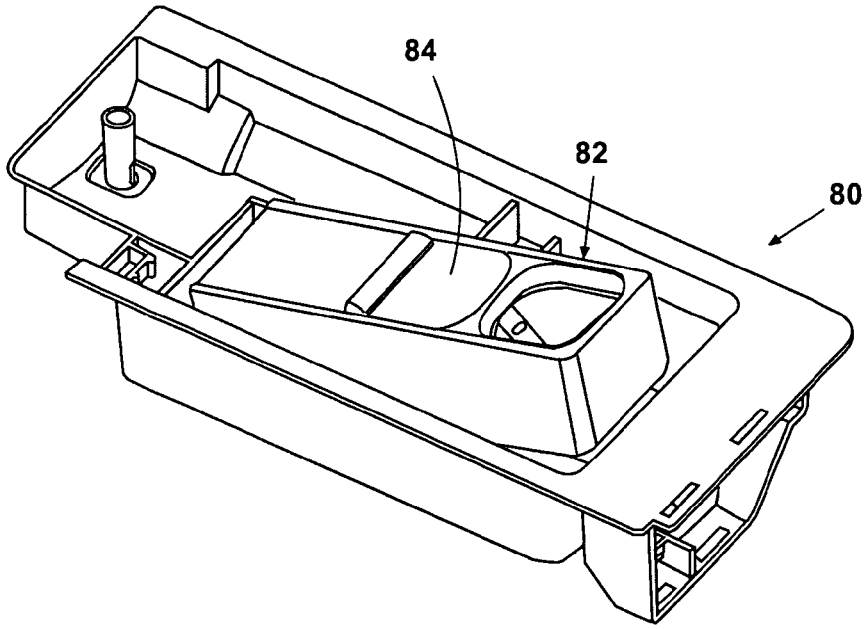
FIG. 4 is a perspective view of a first example of a wash aid dispenser drawer according to one embodiment of the invention, including at least one refractive index sensor assembly for sensing the concentration of a wash aid contained therein.

FIG. 4 illustrates one example of a dispenser drawer 80 suitable for use with the automatic clothes washing machine 10. The dispenser drawer 80 may be a single use dispenser having one or more single use dispensing cups or compartments. One or more of the cups may be configured for receipt of a bulk dispenser cartridge 82, also referred to as a "mini-bulk dispenser," which converts the single use dispenser into a multiple use or bulk dispenser, alone or in combination with the other single use dispensing cups. An example of such a bulk dispenser cartridge is described and illustrated in commonly-owned U.S. patent application Ser. No. 12/165,712, filed Jul. 1, 2008, entitled "A Household Cleaning Appliance With A Dispensing System Operable Between A Single Use Dispensing System And A Bulk Dispensing System," bearing Applicant's docket number US20080054, which is previously incorporated by reference in its entirety. The dispenser cartridge 82 contains a quantity of a wash aid, such as a laundry detergent, sealed therein behind a slidable door 84 (shown open in FIG. 4) and sufficient for several laundering cycles, for example, 8-10 laundering cycles. The use of the dispenser cartridge 82 eliminates the need for a user to measure out a selected volume of wash aid for each laundering cycle.

The dispenser cartridge 82 may be a generally rectilinear, box-like container sized to be received within a complementary compartment of the dispenser drawer 80. The slidable door 84 may provide for ready refilling of the cartridge 82. Although the bulk dispenser cartridge has been described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

After the dispenser cartridge 82 has been properly installed in the dispenser drawer 80, a selected volume of wash aid may be dispensed from the dispenser cartridge 82 into the conduit 38, or into a wash aid flush reservoir (not shown). Water flushed through the conduit 38, or the wash aid flush reservoir, and into the tub 16 by operation of the dispenser valve 26 under the control of the controller 24 may deliver the selected volume of wash aid into the tub 16. This may be accomplished by the user selecting a volume of wash aid on the user interface 22. Alternatively, this may be accomplished by selecting a laundering cycle on the user interface 22, which may then be processed by the controller 24, as modified by optional load characteristics, such as determination of the size of the load, to automatically dispense the appropriate volume of wash aid. The laundry cycle may then proceed as described hereinbefore to provide a wash liquid having a selected volume and selected concentration of wash aid.

Figure 5:
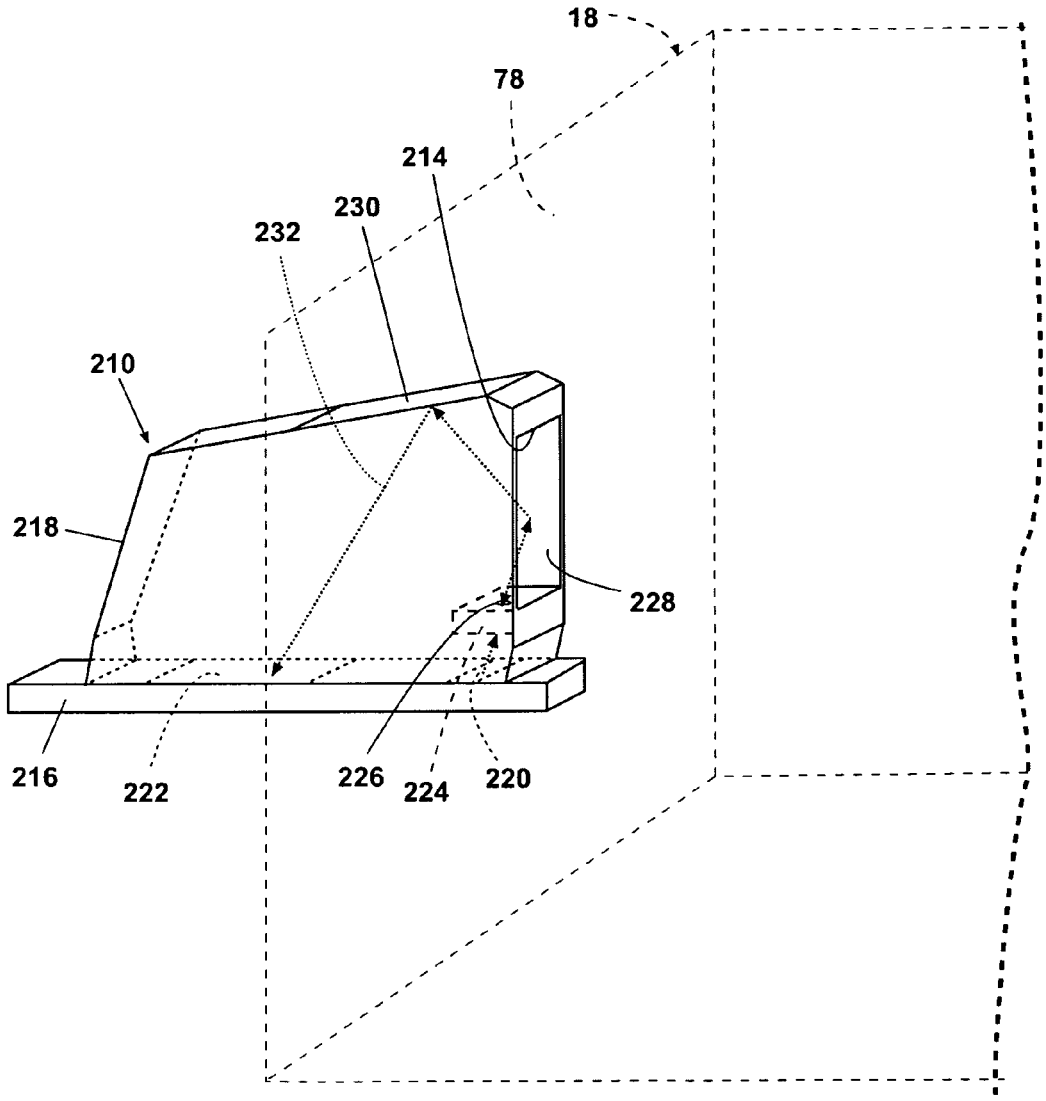
FIG. 5 is an enlarged, partially cutaway view of a sump making up part of the automatic clothes washing machine of FIG. 1 with a refractive index sensor mounted thereto for determining the concentration of a wash aid in a wash liquid residing in the sump according to one embodiment of the invention.

FIG. 5 illustrates an alternate embodiment of a refractive index sensor 210 for incorporation into a sump 18 according to one embodiment of the invention. The sump 18 may have a sump wall 78 in which a sensor opening 214 may be provided. The sensor 210 may be mounted to the exterior of the sump wall 78 in registry with the sensor opening 214.

A suitable refractive index sensor 210 may be a Spreeta™-R sensor manufactured by Sensata Technologies of Attleboro, Mass., although other refractive index sensors could also be used. The sensor 210 includes a base 216 and a housing 218. The housing may be fabricated of a clear material, such as a plastic. The housing 218 includes a glass sensing interface 228 and a reflector 230. The base 216 includes a light source 220 and a photodiode array 222. The light source 220 may comprise one or more light emitting diodes (LEDs) configured to focus light at an angle onto the sensing interface 228. A focusing apparatus 224 may be positioned above the light source 220 and may comprise an aperture 226 for focusing a light beam 232 onto the sensing interface 228. The refractive index sensor 210 may be mounted in the wash aid dispenser drawer 20 so that the sensing interface 228 may be in registry with the sensor opening 214 and can contact the wash aid.

The sensor 210 is based on the optical phenomena of surface plasmon resonance, which occurs when light interacts with a free electron material. In operation, the light from the light source 220 reflects internally off the liquid-glass interface between the sensing interface 228 and the wash aid. The light then reflects off the mirror 230 and onto the photodiode array 222. Depending on the refractive index of the liquid, light striking the surface above a certain angle will be transmitted through the liquid-glass interface instead of being internally reflected. This angle is called the critical angle. This phenomenon results in a dark area or shadow-line on the photodiode array. The location of the shadow-line is indicative of the refractive index. As the refractive index changes, the critical angle also changes and is sensed as a new shadow-line location.

The refractive index sensor 210 may be electrically coupled with the controller 24 so that the concentration of the wash liquid determined by the refractive index sensor 210 may be utilized to control the laundry cycle as hereinbefore described.

With this configuration, the sensing apparatus may be contained entirely on the outside of the sump. Additionally, only one window into the wash liquid may be required, and fewer electrical connections are required.

The washing machine 10 illustrated herein is only one example of a washing machine configuration. Several pumps may be utilized for selected functions, a fewer or greater number of valves may be utilized depending upon the selected fluid line configuration and degree of control desired, and control leads may be incorporated into the washing machine 10 based upon the components for which control by the controller 24 may be desired.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for operating an automatic washing machine during a wash cycle, the automatic washing machine having a cleaning chamber, a sump, a wash aid dispenser fluidly coupled with the cleaning chamber, and a water supply fluidly coupled with the dispenser for flushing wash aid from the dispenser into the cleaning chamber, whereby wash aid flushed from the dispenser mixes with the flushing water to form a wash liquid, the method comprising:

flushing a portion of the wash aid from the dispenser by supplying water to the dispenser, thereby forming a wash liquid of wash aid and water and leaving a remaining portion of the wash aid in the dispenser;

supplying additional water to the wash liquid without flushing the dispenser;

monitoring the cumulative amount of water within the washing machine;

determining a characteristic indicative of the concentration of the wash aid in a wash liquid; and controlling further flushing of the remaining portion of the wash aid from the dispenser and the supplying of additional water to obtain a wash liquid having a predetermined concentration and target volume based on the cumulative amount of water and the determined characteristic.

2. The method in accordance with claim 1 wherein controlling further flushing of the remaining portion of the wash aid from the dispenser comprises selecting a volume of water to be introduced into the automatic washing machine based on the determined characteristic.

3. The method in accordance with claim 1 wherein determining a characteristic indicative of the concentration of the wash aid in a wash liquid occurs after flushing the portion of the wash aid from the dispenser.

4. The method in accordance with claim 1 wherein determining a characteristic indicative of the concentration of the wash aid in a wash liquid comprises determining a concentration of the wash aid in the wash liquid in the sump.

5. The method in accordance with claim 1, further comprising adding at least one rinse cycle to the wash cycle to remove the wash aid from a laundry load.

6. The method in accordance with claim 1 wherein controlling the flushing of the remaining portion of the wash aid from the dispenser comprises dispensing a predetermined quantity of the wash aid based on the determined characteristic.

7. The method in accordance with claim 1, further comprising adding additional water in response to the determined characteristic.

8. The method in accordance with claim 1, further comprising at least one of halting the wash cycle, generating an audio signal, generating a visual signal, and generating an error code based on the determined characteristic.

9. The method in accordance with claim 1, further comprising dispensing a quantity of a suds reducer based on the determined characteristic.

10. The method in accordance with claim 1 wherein determining a concentration of the wash aid comprises determining a refractive index of the wash liquid in the sump.

11. The method in accordance with claim 10 wherein the refractive index of the wash aid is determined by a refractive index sensor.

12. The method in accordance with claim 11 wherein the refractive index sensor is operatively coupled with the sump.

13. The method in accordance with claim 1 wherein the determining of the characteristic indicative of the concentration of the wash aid comprises determining at least one of the electrical conductivity, pH, oxidation/reduction potential, and chemical composition of the wash liquid.

14. The method in accordance with claim 1 wherein the wash aid comprises at least one of a detergent, a water softener, a fabric softener, an anti-sudsing agent, a fabric whitening agent, a fabric brightening agent, a bleach, an in-wash stain remover, a color-safe bleach, a peroxygen bleach, an oxidizing agent, and a disinfectant.

15. The method in accordance with claim 1 wherein the determined characteristic is a refractive index.

16. The method in accordance with claim 1 wherein determining the concentration of the wash aid in the wash liquid is a function of the determined characteristic.

17. The method in accordance with claim 1 wherein the characteristic indicative of the concentration is the concentration of the wash aid in the wash liquid.

18. A method for operating an automatic washing machine, the automatic washing machine having a cleaning chamber, a wash aid dispenser fluidly coupled with the cleaning chamber, and a water supply fluidly coupled with at least one of the dispenser and the cleaning chamber, the method comprising:

initiating a wash cycle;

flushing a portion of wash aid from the dispenser by supplying water to the dispenser, thereby forming a wash liquid of the wash aid and the water and leaving a remaining portion of wash aid in the dispenser;

supplying additional water to the wash liquid without flushing the dispenser;

monitoring the cumulative amount of water within the washing machine;

determining a characteristic indicative of the concentration of the wash aid in the wash liquid;

controlling the flushing of the remaining portion of wash aid from the dispenser and the supplying of additional water to obtain a wash liquid having a predetermined concentration and target volume based on the cumulative amount of water and the determined characteristic;

initiating at least one rinse cycle after the completion of the wash cycle; and initiating at least one spin cycle after the completion of one of the wash cycle and the at least one rinse cycle.

19. The method in accordance with claim 18 wherein the characteristic is a refractive index.

20. The method in accordance with claim 18 wherein determining the concentration of the wash aid in the wash liquid is a function of the determined characteristic.

21. The method in accordance with claim 18 wherein the characteristic indicative of the concentration is the concentration of the wash aid in the wash liquid.

22. The method in accordance with claim 18 wherein controlling the flushing of the remaining portion of wash aid from the dispenser based on the determined characteristic comprises dispensing a quantity of the wash aid based on the determined characteristic.

23. The method in accordance with claim 18, and further comprising adding additional water in response to the determined characteristic.

24. The method in accordance with claim 18, further comprising determining a quantity of wash liquid to be formed.

25. The method in accordance with claim 18 wherein determining a characteristic indicative of the concentration of the wash aid in the wash liquid comprises determining a refractive index of the wash liquid.

26. The method in accordance with claim 25 wherein the refractive index of the wash liquid is determined by a refractive index sensor.

27. A method for operating an automatic washing machine, the automatic washing machine having a cleaning chamber, a dispensing system having a bulk wash aid dispenser cartridge fluidly coupled with the cleaning chamber, and a water supply fluidly coupled with at least one of the dispensing system and cleaning chamber, the method comprising:

dispensing a volume of wash aid from the dispenser cartridge;

flushing a portion of the dispensed volume of wash aid into the cleaning chamber to form a wash liquid, and leaving a remaining portion of the wash aid in the dispensing system;

supplying additional water to the wash liquid without flushing the dispenser;

monitoring the cumulative amount of water within the washing machine;

determining a characteristic indicative of the concentration of the wash aid in the wash liquid residing in the cleaning chamber; and controlling further flushing of the remaining portion of the wash aid and the supplying of additional water to obtain a wash liquid having a predetermined concentration and target volume based on the cumulative amount of water and the determined characteristic.

28. The method in accordance with claim 27 wherein determining the characteristic indicative of the concentration of a wash aid in a wash liquid comprises determining a refractive index of the wash liquid.

29. The method in accordance with claim 28 wherein the refractive index of the wash liquid is determined by a refractive index sensor.

30. An automatic washing machine comprising:

a cleaning chamber for holding a laundry load for laundering;

a tub enclosing the cleaning chamber;

a dispensing system having a wash aid dispenser fluidly coupled with the cleaning chamber;

a water supply fluidly coupled with the wash aid dispenser for flushing wash aid from the dispenser into the cleaning chamber;

a sensor coupled with the tub for determining a characteristic indicative of the concentration of the wash aid in a wash liquid; and a controller operably coupled with the wash aid dispenser, the water supply, and the sensor, and suitable for controlling the following operations during a wash cycle:

flushing a portion of a wash aid from the dispenser by supplying water to the dispenser, thereby forming the wash liquid from wash aid and water and leaving a remaining portion of the wash aid in the dispenser;

supplying additional water to the wash liquid without flushing the dispenser;

monitoring the cumulative amount of water within the washing machine;

determining the characteristic indicative of the concentration of the wash aid in the wash liquid; and controlling further flushing of the remaining portion of the wash aid from the dispenser and the supplying of additional water to obtain a wash liquid having a predetermined concentration and target volume based on the cumulative amount of water and the determined characteristic.

31. The automatic washing machine in accordance with claim 30, and further comprising a sump forming part of the tub wherein the sensor is operatively coupled with the sump.

32. The automatic washing machine in accordance with claim 31 wherein determining a characteristic indicative of the concentration of the wash aid in a wash liquid comprises determining a concentration of the wash aid in the wash liquid in the sump.

33. The automatic washing machine in accordance with claim 30 wherein the sensor is a refractive index sensor.

34. The automatic washing machine in accordance with claim 30 wherein controlling the further flushing of the remaining portion of the wash aid from the dispenser comprises dispensing a predetermined quantity of the wash aid based on the determined characteristic.

35. The automatic washing machine in accordance with claim 30, wherein the controller is further suitable for controlling the following operation: adding additional water in response to the determined characteristic.

36. The automatic washing machine in accordance with claim 30, wherein the controller is further suitable for controlling the following operations: initiating at least one rinse cycle after the completion of the wash cycle, and initiating at least one spin cycle after the completion of one of the wash cycle and the at least one rinse cycle.

37. The automatic washing machine in accordance with claim 30 wherein controlling further flushing of the remaining portion of the wash aid from the dispenser comprises selecting a volume of water to be introduced into the automatic washing machine based on the determined characteristic.

38. An automatic washing machine comprising:

a cleaning chamber for holding a laundry load for laundering;

a tub enclosing the cleaning chamber;

a dispensing system having a bulk wash aid dispenser cartridge fluidly coupled with the cleaning chamber;

a water supply fluidly coupled with the dispensing system for dispensing a wash aid into the cleaning chamber;

a sensor coupled with the tub for determining a characteristic indicative of the concentration of the wash aid in a wash liquid; and a controller operably coupled with the bulk wash aid dispenser cartridge, the water supply, and the sensor, and suitable for controlling the following operations:

combining a portion of a volume of wash aid dispensed from the bulk wash aid dispenser cartridge with a volume of water to form a wash liquid, and leaving a remaining portion of the volume of wash aid in the dispensing system;

supplying additional water to the wash liquid without flushing the dispenser;

monitoring the cumulative amount of water within the washing machine;

determining a characteristic indicative of the concentration of the wash aid in the wash liquid; and controlling further flushing of the remaining portion of the volume of wash aid and the supplying of additional water to obtain a wash liquid having a predetermined concentration and target volume based on the cumulative amount of water and the determined characteristic.

39. The automatic washing machine in accordance with claim 38, and further comprising a sump forming part of the tub wherein the sensor is operatively coupled with the sump.

40. The automatic washing machine in accordance with claim 39 wherein determining a characteristic indicative of the concentration of the wash aid in a wash liquid comprises determining a concentration of the wash aid in the wash liquid in the sump.

41. The automatic washing machine in accordance with claim 38 wherein the sensor is a refractive index sensor.

42. The automatic washing machine in accordance with claim 38 wherein controlling further flushing of the remaining portion of the volume of wash aid from the bulk wash aid dispenser cartridge comprises dispensing a predetermined quantity of the wash aid based on the determined characteristic.

43. The automatic washing machine in accordance with claim 38, wherein the controller is further suitable for controlling the following operation: adding additional water in response to the determined characteristic.

44. The automatic washing machine in accordance with claim 38, wherein the controller is further suitable for controlling the following operations: initiating at least one rinse cycle after the completion of a wash cycle, and initiating at least one spin cycle after the completion of one of a wash cycle and the at least one rinse cycle.

* * * * *

UNITED STATES PATENT AND TRADEMARK OFFICE

CERTIFICATE OF CORRECTION

PATENT NO. : 8,397,328 B2
APPLICATION NO. : 12/166193
DATED : March 19, 2013
INVENTOR(S) : Hendrickson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1015 days.

Signed and Sealed this
Sixteenth Day of December, 2014

Michelle K. Lee

Michelle K. Lee
*Deputy Director of the United States Patent and Trademark Office*